United States Patent [19]

Looss et al.

[11] 4,172,409

[45] Oct. 30, 1979

[54] FIRE CONTROL SYSTEM FOR VEHICLE-MOUNTED WEAPON

[75] Inventors: Helmut Looss, Hamburg; Bernd Eschenburg, Uetersen, both of Fed. Rep. of Germany

[73] Assignee: Licentia Patent-Verwaltungs-G.m.b.H., Frankfurt, Fed. Rep. of Germany

[21] Appl. No.: 804,794

[22] Filed: Jun. 8, 1977

[30] Foreign Application Priority Data

Jun. 8, 1976 [DE] Fed. Rep. of Germany ..... 2625667

[51] Int. Cl.[2] ..... F41G 5/14

[52] U.S. Cl. ..... 89/41 E; 235/407; 364/423

[58] Field of Search ..... 33/236, 237, 238, 239, 33/240; 89/41 D, 41 E, 41 EA, 41 AA, 41 CE; 235/407; 364/423

[56] References Cited

U.S. PATENT DOCUMENTS

| | | | |
|---|---|---|---|
| 2,407,191 | 9/1946 | Tear et al. | 33/236 |
| 3,405,599 | 10/1968 | Barlow et al. | 89/41 CE |
| 3,575,085 | 4/1971 | McAdam | 89/41 E |
| 3,848,509 | 11/1974 | Corn | 89/41 AA |

*Primary Examiner*—Stephen C. Bentley

*Attorney, Agent, or Firm*—Spencer & Kaye

[57] ABSTRACT

In a fire control system for a weapon installed on a vehicle and including a stabilized sighting mechanism and a stabilized weapon, a range finder coupled to the sighting mechanism, and a fire control computer for calculating the lead and elevation angles to a target, circuitry is provided to automatically compensate for the inherent movement of the vehicle in the computation of the lead angle.

5 Claims, 4 Drawing Figures

SENSED VALUES
AMMUNITION
RANGE, E
1
$\Psi_0$
$\varphi$
2
TILTING CORRECTOR
$T_F$
10
MULTIPLIER
9
8
FILTER
$\Psi_{TW}$
1/E
$\omega_{ACT}$
$V_F$
$V_T$
$\omega_R$
$\omega_{RATED}$
6
7
MULTIPLIERS
3
4
5
HAND CONTROL
STABILIZING SYSTEM
PLATFORM SENSED VALUES
AMMUNITION
RANGE, E
1
$\Psi_0$
$\varphi$
2
TILTING CORRECTOR
$T_F$
12
11
FILTER
$\Psi_{TW}$
1/E
$\omega_{ACT}$
$V_F$
$V_T$
$\omega_R$
$\omega_{RATED}$
6
7
3
4
5

FIRE CONTROL SYSTEM FOR VEHICLE-MOUNTED WEAPON

BACKGROUND OF THE INVENTION

The present invention relates to a fire control system for guns installed on a vehicle and having a stabilized sighting mechanism and a stabilized gun or gun platform, a range finder coupled with the sighting mechanism and a fire control computer for calculating the lead angle and the angle of elevation.

In modern tank fire control systems, stabilization systems are generally employed for the sighting mechanisms and the weapons systems in order to permit aiming and firing during travel of the vehicle. Fire control computers in conjunction with range finders and additional sensors for internal and external ballistic parameters calculate the correction angle for azimuth and elevation. Such an arrangement is disclosed in U.S. Pat. No. 3,575,085.

These fire control computers are usually constituted by electromechanical calculators, electronic analog computers, digital computers or hybrid computers. In order to limit costs, they often are constructed to utilize approximations of certain of the relationships involved in the computations.

Fire control systems of this type already provide an advantageous increase in fighting efficiency. Observation during travel is possible. Firing on stationary targets is effected during an abbreviated firing stop.

In order to fire while traveling and/or on moving targets, it is generally known that, due to the finite flight time of the projectile and the relative movement of the target, lead angles must be considered. These lead angles are usually formed only for lateral, or azimuthal movement, and in some fire control systems additionally also for elevational movement, from the product of the flight time of the projectile, calculated by the fire control computer, and the rated values or the actual values of the angular tracking velocity.

Since the gunner cannot follow the target with his range finder in a constant movement, but rather the crosshair more or less oscillates around the target, the angular velocity indication oscillates correspondingly and the lead angle indication is correspondingly falsified.

Filters with appropriate time constants, or sample and hold or similar memory circuits are used for smoothing. Such filters are employed in the prior art for various purposes unrelated to weapons systems.

Linear filters have the drawback that, due to their required large time constants, the moment of firing is unduly delayed. The storing processes then furnish wrong lead values if, after the moment of sampling, the lead conditions change, as is the case, for example, when traveling around a curve.

SUMMARY OF THE INVENTION

It is therefore an object of the present invention to provide a system which economically avoids oscillation, or pendulation, of the crosshair around the target.

This and other objects are achieved, according to the invention by providing means in the fire control computer to automatically derive the control signals for holding the target in a manner to compensate for the inherent movement of the vehicle and the lead angle influenced by the inherent movement, from the characteristic values of the vehicle and thus ease the gunner's task and avoid errors as a result of his behavior.

To accomplish this, a directional signal, $\omega_R$ is formed from the vehicle speed $V_F$ of the tank, the angle $\psi$ between the direction of travel and the direction of the target and the range E of the target according to the equation $$\omega_R = \frac{v_F}{E} \cdot \sin\psi$$

so that the target is continuously held in the sight independent of the behavior of the gunner even while moving past the target.

With this processing of the signals utilized to control the lead angle it is possible to accurately form the signals for the follow-up and lead angle resulting from the inherent movement of the tank so that they correspond to the respective momentary value and to set them into the fire control system. The directional signals from the gunner serve only as fine adjustments and possibly to compensate for movement of the target and can be sufficiently smoothed, with the undulations resulting from behavior of the gunner being known, so that it becomes possible to execute sudden changes in course for protection of the tank even during the target finding process without thus reducing the chances for a hit as a result of lead errors.

DESCRIPTION OF THE PREFERRED EMBODIMENTS

Figure 1:
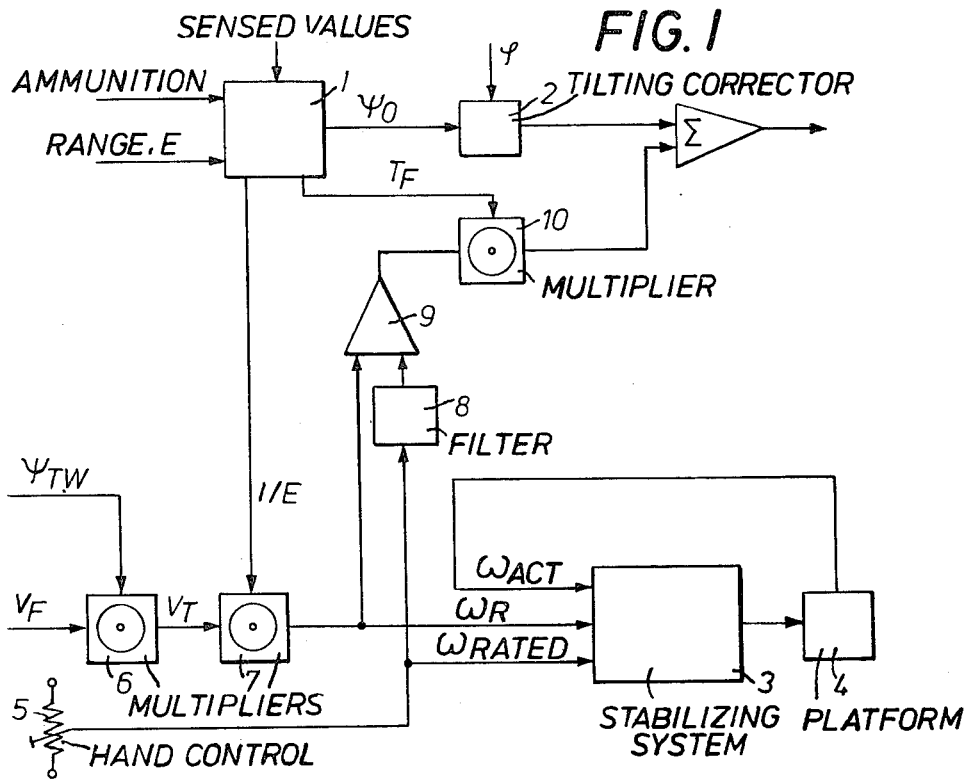
FIGS. 1 and 2 are block circuit diagrams of preferred embodiments of the invention.

FIG. 1 illustrates a data processing system including a ballistic computer 1 which calculates the elevation and lead angle of the weapon from the values for the range E and the type of ammunition employed as well as from sensed values. Such a system could be disclosed in U.S. Pat. No. 3,575,085. During tilting of the vehicle, such tilting is taken into consideration by a tilting corrector 2. For the kinematic lead angle, computer 1 provides the projectile flight time $T_F$.

A stabilized sighting mechanism includes an electronic stabilizing system 3 and the weapon platform 4 which is to be stabilized and which carries the sighting mechanism. The sighting mechanism is guided by means of a hand control 5 which imparts to it a signal representing the rated value of the angular velocity, $\omega_{rated}$, corresponding to the angular movement of the gun platform relative to the vehicle. At the same time the angular velocity signal is a measure for the movement of the target. This movement is taken into consideration in the fire control computer by a value representing the kinematic lead angle $\alpha_1 = \omega_{rated} \cdot T_F$.

For the inherent movement, the guiding velocity $\omega_R$ is calculated in multiplication circuits 6 and 7 from the speed of the vehicle $v_F$, provided by a tachometer connected to the vehicle engine, the turret angle $\psi_{TW}$ provided by a sensor driven with the turret, and the reciprocal of the range, 1/E, according to the equation $$\omega_R = v_F \sin\psi_{TW} \cdot 1/E.$$

The signal coming from circuit 7 is fed to the stabilizing electronic system 3 of the sighting mechanism as a follow-up signal. Thus the sighting mechanism automatically remains locked on the target during travel of the tank. The lead angle based on the inherent movement can be derived by multiplication of the follow-up signal $\omega_R$, with the flight time, $T_F$, according to the equation $$\alpha_2 = \omega_R \cdot T_F.$$

The entire kinematic lead angle results from $\alpha_1 + \alpha_2 = \alpha$.

System 3 also receives in feedback an actual angular velocity value signal, $\omega_{act}$, from platform 4, and thus delivers to the platform a signal representative of $\omega_R + \omega_{rated} - \omega_{act}$.

Possible undulations in the guiding hand control signal $\omega_{rated}$ can be smoothed by a filter 8. The signals $\omega_R$ and smoothed $\omega_{rated}$ then are added together in a summing member 9 and are then linked with the flight time $T_F$ in a multiplier 10.

Figure 2:
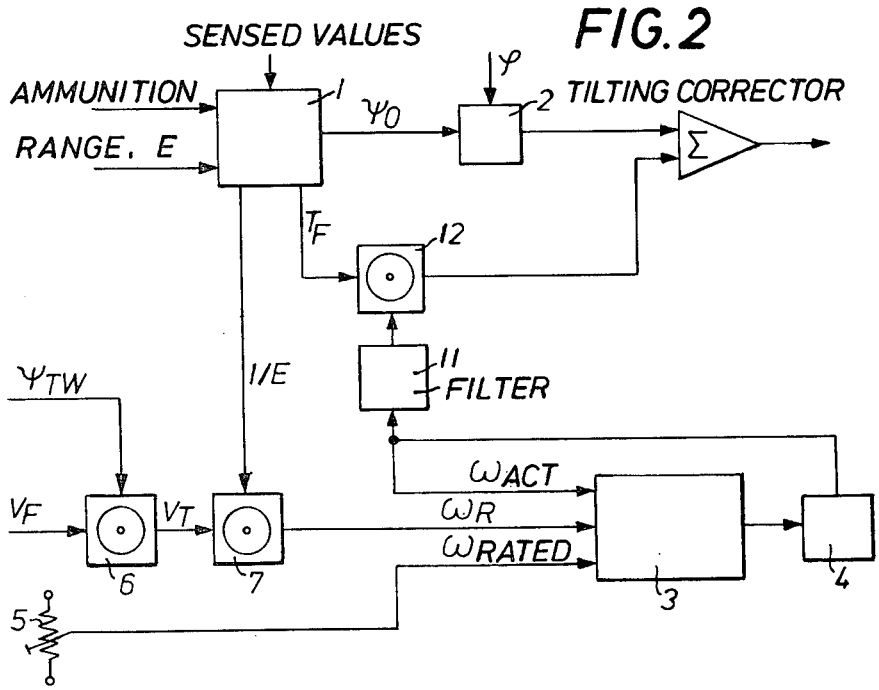

In departure from FIG. 1, in the embodiment of FIG. 2 the inherent movement and rated movement signals $\omega_R$ and $\omega_{rated}$ are added together in the stabilization electronic system 3. The actual angular speed value $\omega_{act}$ is thus representative of the sum of the inherent movement of the vehicle and the relative movement of the target. This signal is smoothed in a filter 11 and is linked in multiplier 12 with the flight time $T_F$ to form the total kinematic lead angle $\alpha$.

Compared to the embodiment of FIG. 1, the circuit of FIG. 2 is more dependable in operation. If the follow-up signal $\omega_R$ were missing, the gunner would have to correct the sighting mechanism with the aid of the hand control when the tank is moving, so that the lead angle signals could be formed in the known manner.

The structure of the circuit units 1, 2, 3 and 5 in FIGS. 1 and 2 is comparable to that of the corresponding parts of the above-mentioned U.S. Pat. No. 3,575,085. Hence, the circuit unit 1 in the drawing of this application is the equivalent of the computer 54 in FIG. 2 of the known system. The circuit unit 2 in the drawing of this application, which takes into consideration the tilting of the vehicle, is contained in the circuit unit 60, FIG. 2, of the U.S. Patent which effects the coordinate conversion. Circuit unit 3 of the drawing of this application, which is the stabilizing system for the platform, corresponds in its function to the parts of FIG. 4 of the Patent bearing the reference numbers 32, 34, 126, 128, 130, 132, 134, and 166. The control handle 5 in the drawing of this application is comparable to FIG. 2, circuit unit 38.

Furthermore, the circuit unit 8 in the drawing of this application is a commercial smoothing filter for smoothing the adjustment movement performed by the gunner. This lag network has the same transfer function $$\frac{1}{1 + 2\frac{\xi}{\omega_n} \cdot s + \frac{s^2}{\omega_n^2}}$$

as described for example in J. G. Truxal's "Control Engineer's Handbook", 1958, Mc Graw Hill.

Figure 3:
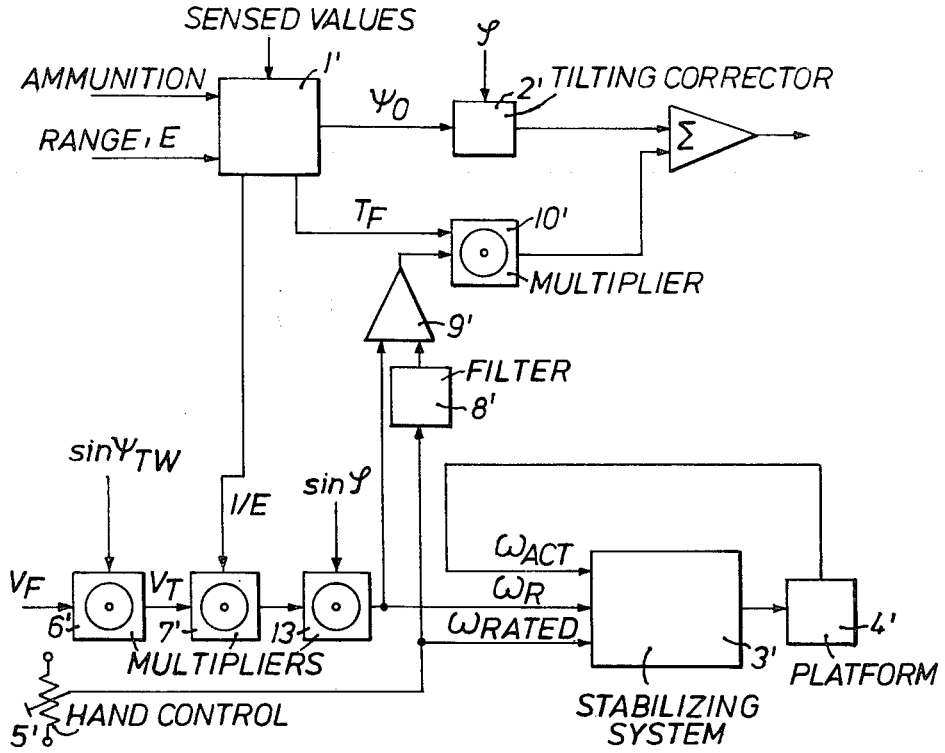
FIG. 3 is a block diagram for determining the elevation.

While FIGS. 1 and 2 illustrate block circuit diagrams for the determination of the azimuth control of the weapon of a vehicle, FIG. 3 is an example for determining the elevation. Since the parts in FIG. 3 are identical to those in FIGS. 1 and 2, an ′ is added to the reference numbers in FIG. 3. In this Figure, a multiplier 13 is added to which the trunnion cant sin $\psi$ is fed which takes the elevation part of the vehicle velocity into consideration. The output signal of the three series-connected multipliers 6′, 7′, and 13 is fed to both the stabilizing system 3′ and the summing member 9′. FIGS. 1 and 3 could also have been depicted in a single figure in which two conductors, each for azimuth and elevation could have been arranged between the block circuit diagrams.

Figure 4:
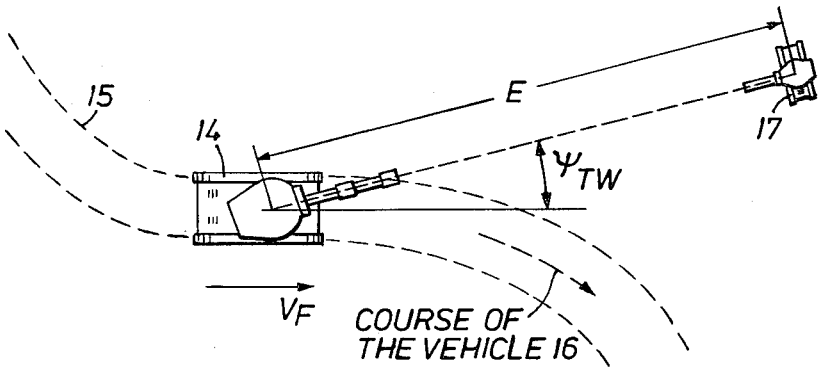
FIG. 4 is a plan view showing the relations between the various data.

FIG. 4 is a plan view illustrating the relation of the above data to each other. The vehicle 14 travels at a speed $V_F$ on a path 15. The direction of travel is indicated by an arrow 16. The vehicle 14 has acquired a target 17. E is the range between the vehicle 14 and the target 17 while $\psi_{TW}$ is the angle between the direction of travel and the direction to the target. From these data, a directional signal is formed as described above.

It will be understood that the above description of the present invention is susceptible to various modifications, changes and adaptations, and the same are intended to be comprehended within the meaning and range of equivalents of the appended claims.

What is claimed is:

1. In a fire control system for a weapon which is mounted on a rotatable platform installed on a vehicle and including a stabilized sighting mechanism and a stabilized weapon, a range finder coupled to the sighting mechanism, a fire control computer connected for calculating the lead and elevation angles to a target, and means for automatically compensating for the inherent movement of the vehicle in the computation of the lead angle comprising: a source of a signal representing the momentary speed of the vehicle; a source of a signal representing the angular position of said platform relative to the direction of vehicle travel; and first signal processing means connected to said sources and to the range finder for producing a follow-up signal representative of the mathematical product of the vehicle speed and the platform angular position divided by the target range and constituting a representation of a guiding angular velocity value relating to vehicle movement; the improvement wherein said source of signal representing the momentary speed of the vehicle includes a tachometer which is connected to the vehicle engine, and which continuously provides an output signal representative of the speed of the vehicle; and wherein said source of signal representing the angular position of said platform relative to the direction of vehicle travel includes a sensor, driven with said platform, for continuously providing an output signal representative of said angular position of said platform.

2. An arrangement as defined in claim 1 further comprising means deriving a rated value signal representing the angular velocity of said sighting mechanism relative to the vehicle, and means in said sighting mechanism connected for producing a signal representative of the sum of the follow-up signal and the rated value signal.

3. An arrangement as defined in claim 2 further comprising filter means connected for eliminating short time variations in the rated value signal, said filter having a time characteristic optimally adapted to the signal characteristics.

4. An arrangement as defined in claim 2 further comprising a sample and hold circuit connected for eliminating short time variations in the rated value signals.

5. An arrangement as defined in claim 2 wherein said computer is arranged for calculating both azimuth and elevation lead angles.

* * * * *